US008006350B2

(12) United States Patent
Chen

(10) Patent No.: US 8,006,350 B2
(45) Date of Patent: Aug. 30, 2011

(54) FILE HANDLE

(75) Inventor: Kun-Chen Chen, Taichung Hsien (TW)

(73) Assignees: Kun-Chen Chen, Taichung Hsien (TW); Pell Industrial L.L.C., Preston, WA (US)

( * ) Notice: Subject to any disclaimer, the term of this patent is extended or adjusted under 35 U.S.C. 154(b) by 428 days.

(21) Appl. No.: 12/344,698

(22) Filed: Dec. 29, 2008

(65) Prior Publication Data

US 2010/0162528 A1 Jul. 1, 2010

(51) Int. Cl.
*B25G 3/32* (2006.01)

(52) U.S. Cl. ..... 16/422; 16/431; 16/DIG. 24; 407/29.15

(58) Field of Classification Search ..... 16/422, 16/431, 436, DIG. 24; 81/489; 407/29.1, 407/29.15; 294/57; 7/167; D8/83, 107
See application file for complete search history.

(56) References Cited

U.S. PATENT DOCUMENTS

| | | | | | |
|---|---|---|---|---|---|
| 73,804 | A * | 1/1868 | Halton | 407/29.15 |
| 288,047 | A * | 11/1883 | French | 407/29.15 |
| 1,119,827 | A * | 12/1914 | Jacobson | 16/422 |
| 1,994,522 | A * | 3/1935 | Klingler | 407/29.15 |
| 2,475,608 | A * | 7/1949 | Gasparich | 407/29.15 |
| 2,809,846 | A * | 10/1957 | Whiteford | 407/29.15 |
| 4,371,282 | A * | 2/1983 | Sturm | 16/422 |
| 4,524,484 | A * | 6/1985 | Graham | 16/429 |
| 4,541,139 | A * | 9/1985 | Jones et al. | 15/171 |
| 4,941,246 | A * | 7/1990 | Finnegan | 16/422 |
| 5,037,235 | A * | 8/1991 | Aquilina | 16/427 |
| 6,109,619 | A * | 8/2000 | Fine | 407/29.15 |
| 7,065,824 | B2 * | 6/2006 | Petner | 16/422 |

* cited by examiner

*Primary Examiner* — Victor Batson
*Assistant Examiner* — Jeffrey O'Brien
(74) *Attorney, Agent, or Firm* — Alan Kamrath; Kamrath & Associates PA

(57) ABSTRACT

A file handle has a handle and a connector. The handle has a sleeve formed on one end and having a clamp and a shaft hole. The clamp has multiple resilient claws. The shaft hole is formed in the clamp. The connector is detachably mounted on the sleeve of the handle and adjustably presses the clamp to selectively adjust the clamp. A blade may be a file, rasp or chisel and has a shaft corresponding to and being mounted in the shaft hole of the clamp and being securely clamped by the clamp. Therefore, the file handle can be carried easily and may be used with a file, rasp, chisel or the like for improved convenience and portability.

10 Claims, 8 Drawing Sheets

FILE HANDLE

BACKGROUND OF THE INVENTION

1. Field of the Invention

The present invention relates to a handle, and more particularly to a file handle with changeable file blades for improved convenience and versatility.

2. Description of Related Art

With reference to FIG. 8, a conventional file comprises a file handle (60) mounting on a file blade (50).

The conventional file handle (60) is wood and has an attachment end and a ferrule (61).

The ferrule (61) is mounted on the end of the file handle (60) and has a file hole (62), an edge and a lip (63). The file hole (62) is formed through the ferrule (61). The lip (63) is formed on the edge of the ferrule (61) and around the attachment end of the file handle (60).

The file blade (50) comprises a bar (51), shoulders (52) and a tang (53).

The bar (51) of the file blade (50) has two surfaces and multiple teeth. The surfaces may be flat, hemispherical or a combination thereof. The teeth are formed on the surfaces of the bar (51). The shoulders (52) are formed on the bar (51). The tang (53) is formed on and protrudes from the shoulders (52), tapers to a point, is mounted through the file hole (62) and inserted in the file handle (60).

Since the conventional file has a fixed file blade (50) multiple files must be carried for different jobs, which is inconvenient. Furthermore, during use, the tang (53) of the conventional file may loosen and be drawn out from the file handle (60) so requiring fixing or replacement.

SUMMARY OF THE INVENTION

The main objective of the invention is to provide a file handle with changeable files for improved convenience and versatility.

The file handle in accordance with the present invention has a handle and a connector. The handle has a sleeve formed on one end having a clamp and a shaft hole. The clamp comprises multiple resilient claws. The shaft hole is formed in the clamp. The connector is detachably mounted on the sleeve of the handle and adjustably presses the clamp to selectively adjust the clamp. A blade may be a file, rasp or chisel and has a shaft corresponding to and being mounted in the shaft hole of the clamp and being securely clamped by the clamp. Therefore, the file handle can be carried easily and may be used with a file, rasp, chisel or the like for improved convenience and portability.

Other objects, advantages and novel features of the invention will become more apparent from the following detailed description when taken in conjunction with the accompanying drawings.

DETAILED DESCRIPTION OF PREFERRED EMBODIMENT

Figure 1:
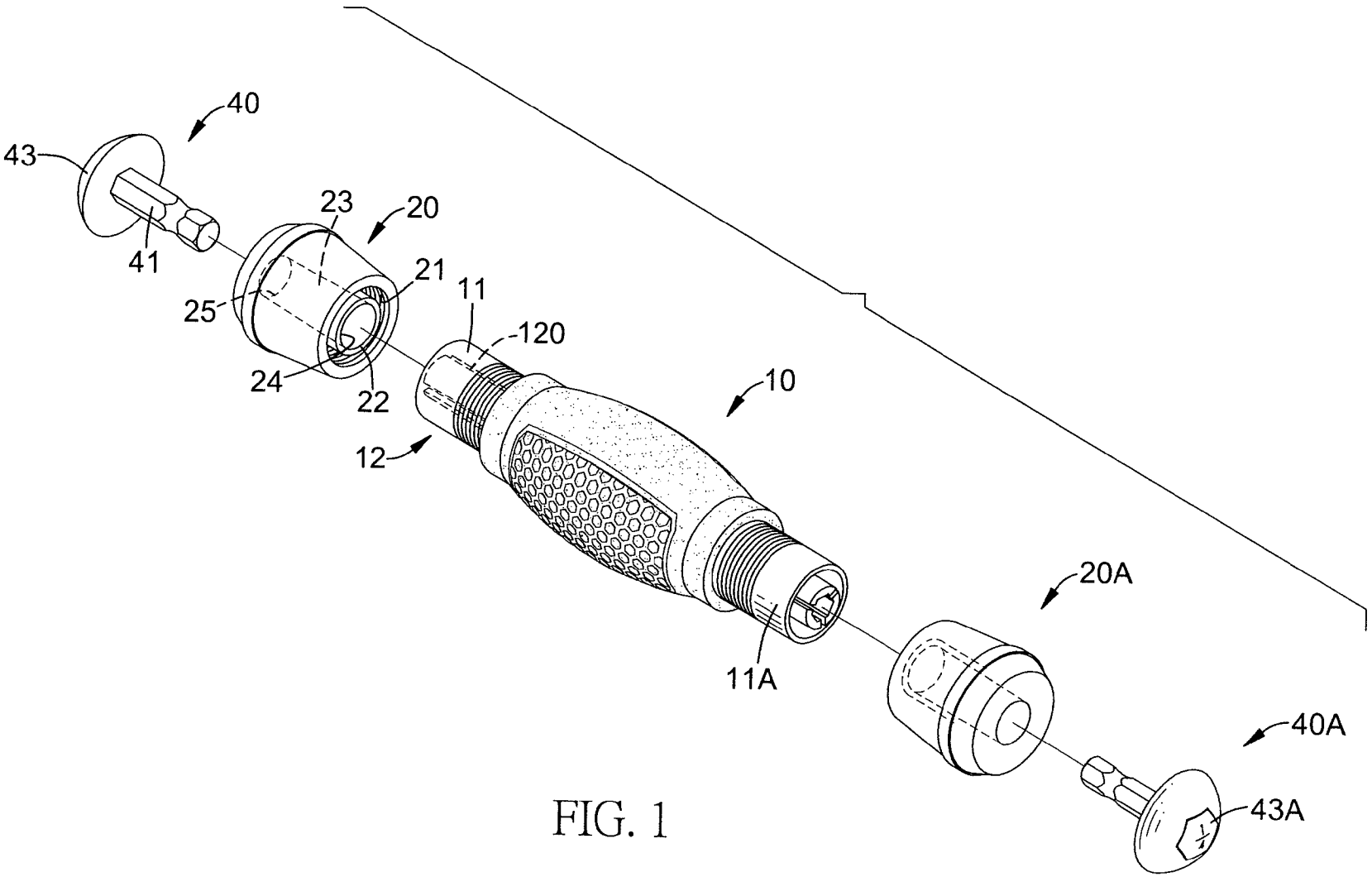
FIG. 1 is an exploded perspective view of a file handle in accordance with the present invention.

With reference to FIGS. 1 and 4 to 6, a file handle in accordance with the present invention comprises a handle (10), at least one connector (10, 20) at least one optional cap (40). The file handle connects with a blade (30, 30A, 30B) in use.

The handle (10) has an optional grip and at least one sleeve (11, 11A) formed respectively on at least one end of the handle (10), and two sleeves (11, 11A) may be implemented.

Figure 2:
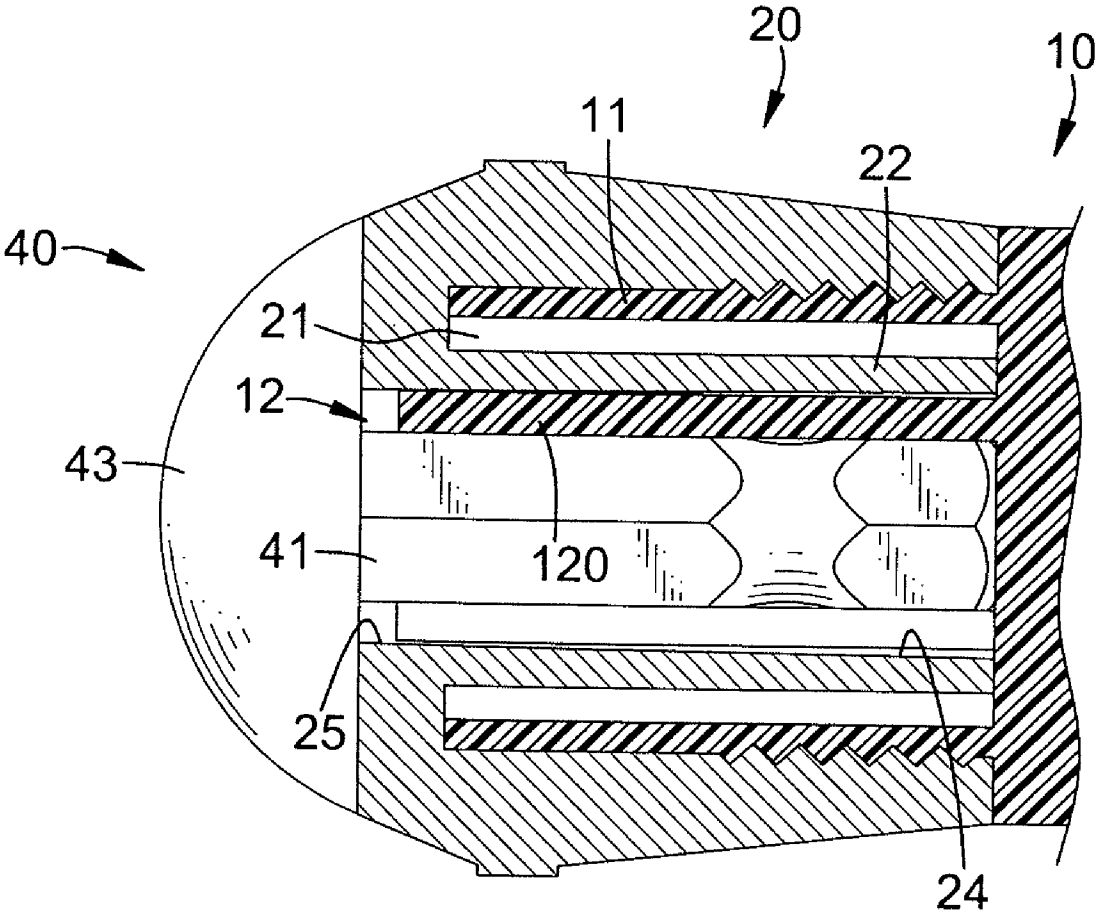
FIG. 2 is an enlarged side view in partial section of the file handle in FIG. 1.

The at least one sleeve (11, 11A) is formed respectively on the at least one end of the handle. Each sleeve (11, 11A) has an outer thread, a recess and a clamp (12). The recess has a bottom. The clamp (12) is formed in and protrudes from the bottom of the recess and comprises multiple claws (120) and a shaft hole. The claws (120) are resilient, are formed at intervals and protrude from the bottom of the recess. The clamp (12) may comprise three claws (120). The shaft hole is formed between the claws (120) and may be hexagonal. When two sleeves (11, 11A) are implemented, the clamps (12) may be different sizes. With further reference to FIG. 2, the at least one connector (20) is mounted respectively around the at least one sleeve (11, 11A) of the handle (10) and each one adjustably presses the claws (120) of a corresponding clamp (12). Each one of the at least one connector (20) is a tube and has an inner annular surface, an outer edge, a shoulder and a mounting tube (22). The inner annular surface of the connector (20) has a mounting thread (21). The mounting thread (21) corresponds to and engages the outer thread of the corresponding sleeve (11). The shoulder of the connector (20) is formed on the outer edge of the connector (20). The mounting tube (22) is formed on and protrudes from the shoulder of the corresponding connector (20), abuts the claws (120) of the corresponding clamp (12) and conically widens away from the shoulder of the connector (20). As the connector (20) is tightened on the corresponding sleeve (11), the mounting tube (22) compresses the claws (120) so contracting the clamp (12).

Figure 3:
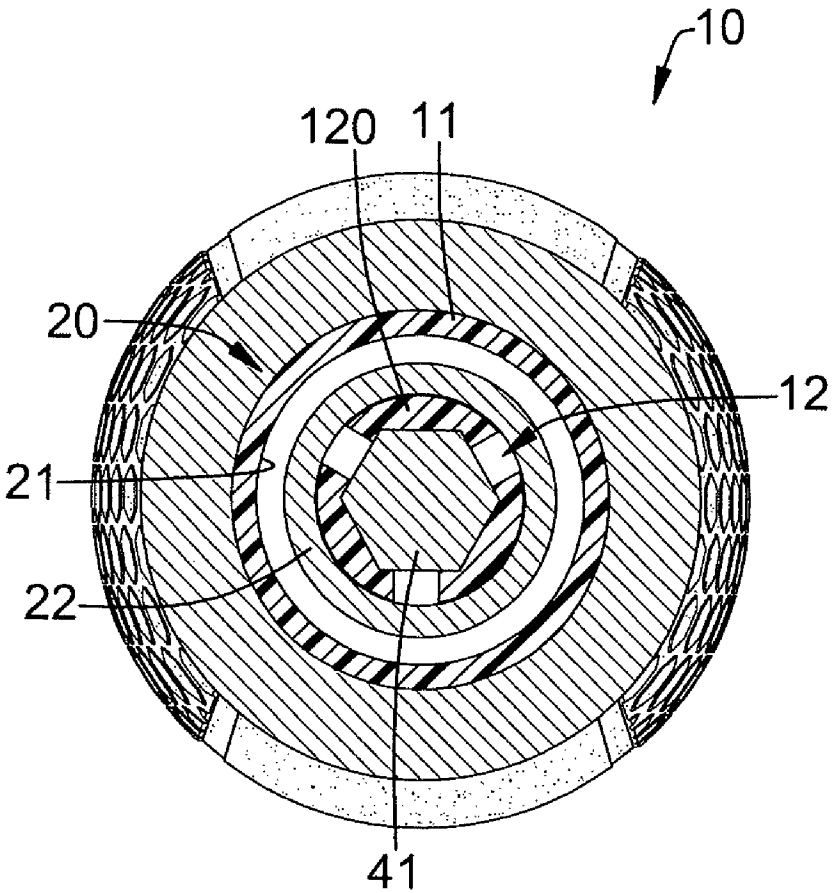
FIG. 3 is an enlarged cross sectional end view of an end of the file handle in FIG. 1.
Figure 4:
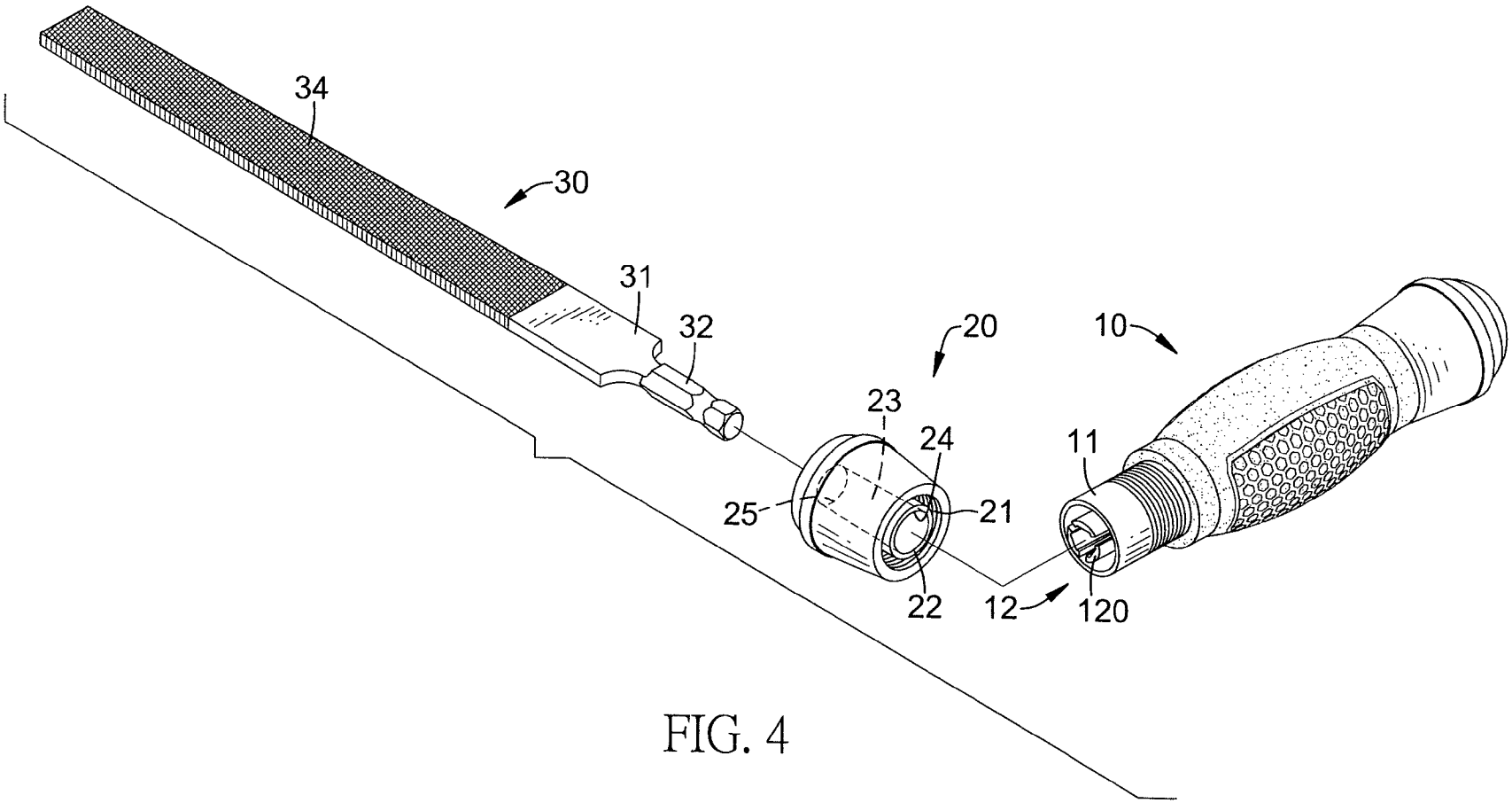
FIG. 4 is a partially exploded perspective view of the file handle in FIG. 1 fitted with a file.
Figure 5:
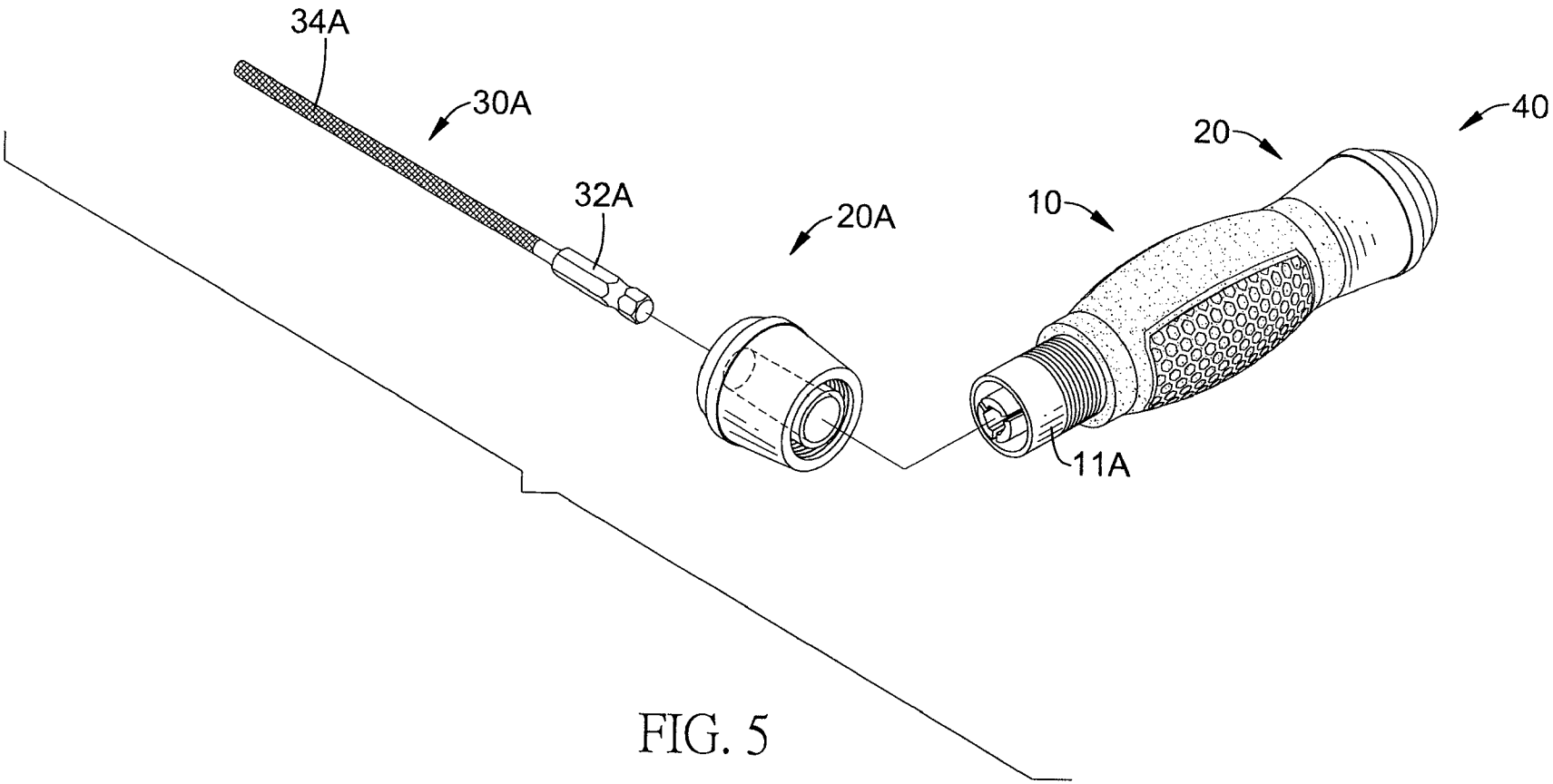
FIG. 5 is a partially exploded view of the file handle in FIG. 1 fitted with a cylindrical file.
Figure 6:
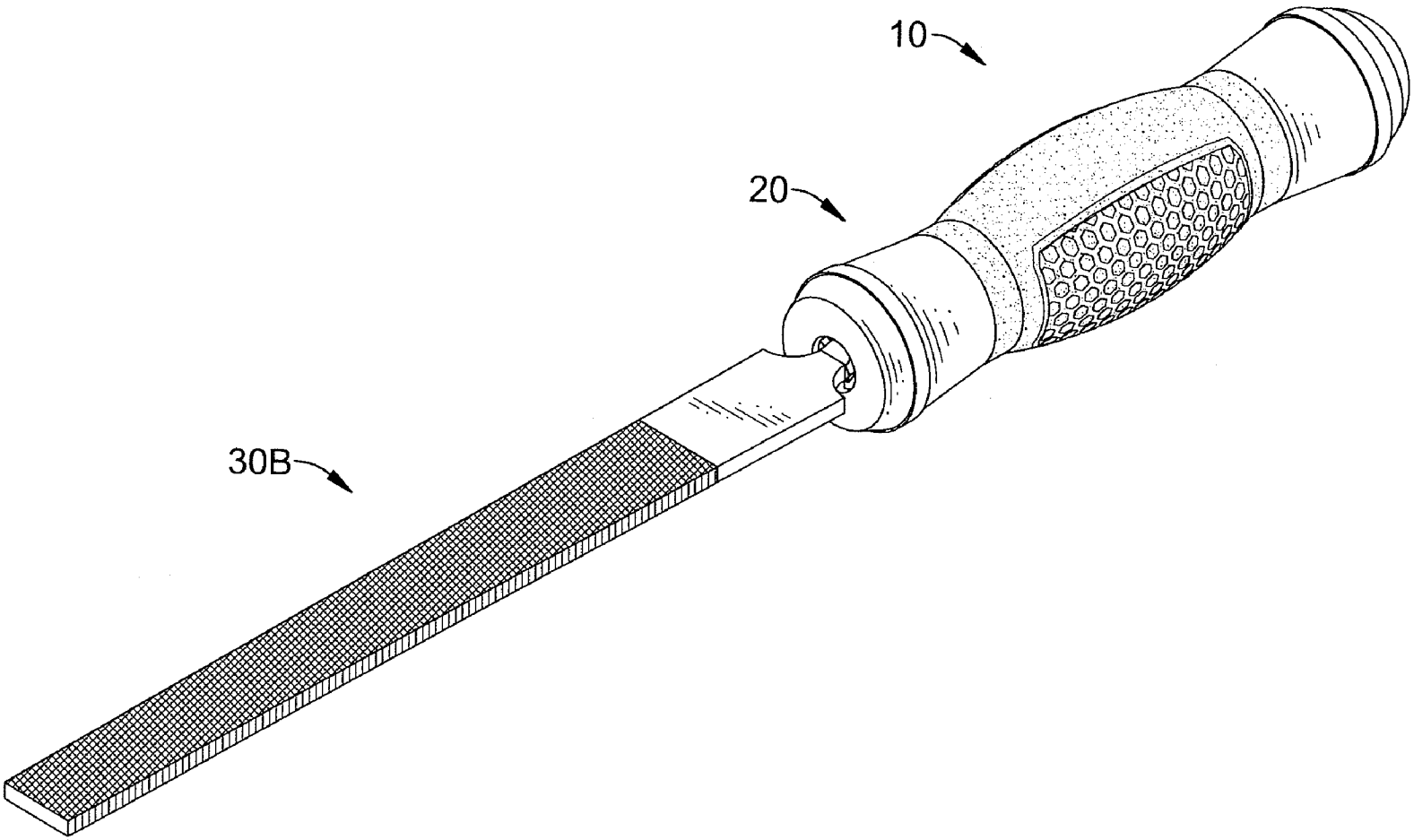
FIG. 6 is a perspective view of the file handle in FIG. 1 fitted with a rasp.

With further reference to FIG. 3, the at least one cap (40, 40A) is detachably mounted respectively through the at least one connector (20, 20A) and mounted respectively on the at least one sleeve (11, 11A) of the handle (10). Each one cap (40, 40A) has an outer surface (43), an inner surface and a shaft (41). The outer surface (43) of the cap (40, 40A) is a convex to provide a smooth surface for holding the file handle comfortable. The inner surface of the cap (40, 40A) abuts a corresponding connector (20, 20A). The shaft (41) is formed on and protrudes from the inner surface of the cap (40, 40A), corresponds to and is detachably mounted in the shaft hole of the corresponding clamp (12) of the handle (10), may be hexagonal in cross section and may have an annular groove. The annular groove of the shaft (41) is formed in the shaft (41). When two sleeves (11, 11A) having different sized clamps (12) are implemented, two caps (40, 40A) are implemented having shafts (41) respectively corresponding to the clamps (12).

The blade (30, 30A, 30B) may be a file, rasp, chisel or the like and has a bar (34, 34A), a shoulder (31, 31A) and a tang (32, 32A). The bar (34, 34A) has two surfaces and multiple teeth. The surfaces of the bar (34, 34A) may be flat, hemispherical or a combination thereof. The teeth are formed on the surfaces of the bar (34, 34A). The shoulder (31, 31A) is formed on the bar (34, 34A). The tang (32, 32A) corresponds to and is detachably mounted in the shaft hole of the clamp (12) of the handle (10), may be hexagonal in cross section and may have an annular groove. The annular groove of the tang (32, 32A) is formed in the tang (32, 32A).

When two sleeves (11, 11A) having different sized clamps (12) are implemented, the tangs (32, 32A) of the files (30, 30A, 30B) may correspond to either size clamp (12) depending on size, length and the like.

The grip is mounted around the handle (10) and is formed between the two ends of the handle (10). The grip may be plastic or rubber.

Figure 7:
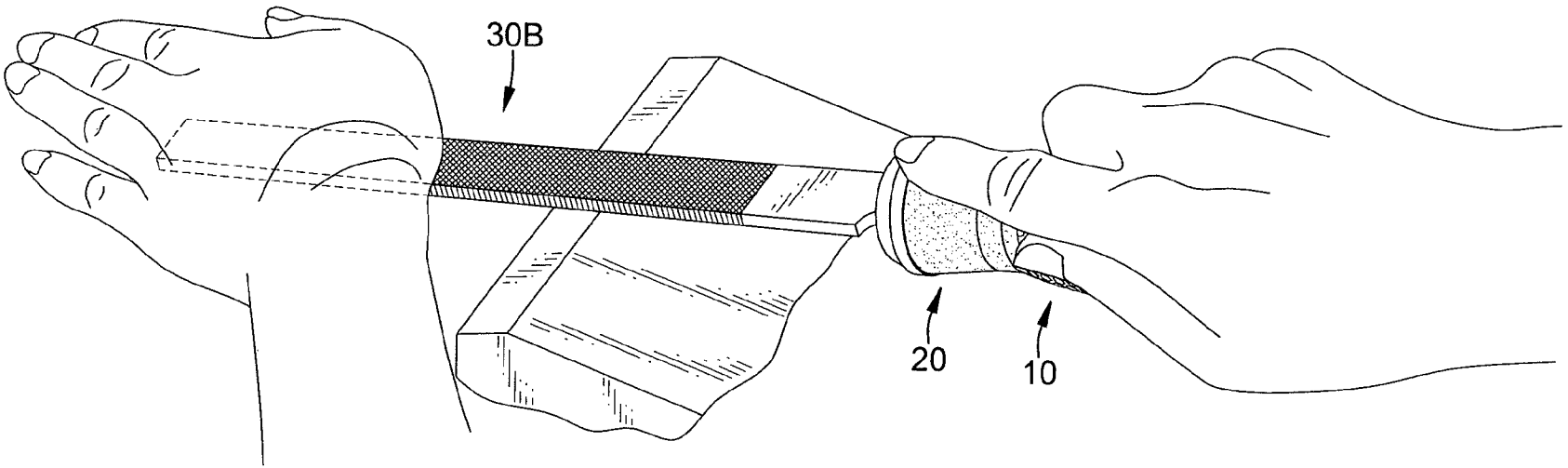
FIG. 7 is an operational perspective view of the file handle in FIG. 6.
Figure 8:
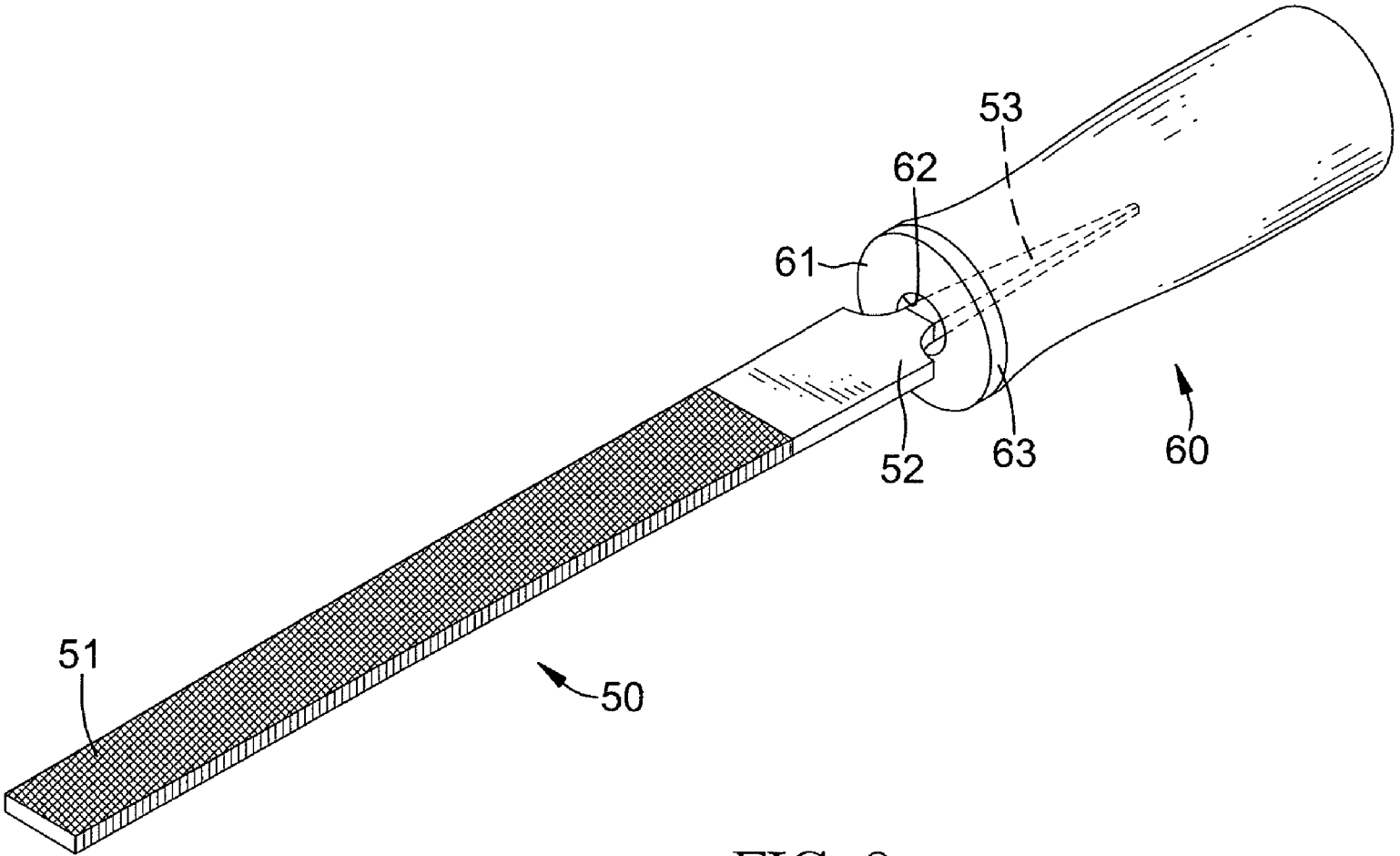
FIG. 8 PRIOR ART
FIG. 8 is a perspective view of a conventional file in accordance with the prior art.

With further reference to FIG. 7, the blade (30, 30A, 30B) is mounted through the connector (20) and in the sleeve (11) of the handle (10) and the sleeve (11) is tightened using the connector (20). The handle (10) is held to control the blade (30, 30A, 30B) to shape wood, metal or the like. The blade (30, 30A, 30B) is selected according to different jobs, and may be changed easily for improved convenience.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A file handle comprising:

a handle having at least one end;

at least one sleeve being formed respectively on the at least one end of the handle, and each one of the at least one sleeve having an outer thread;

a recess having a bottom; and a clamp being formed in and protruding from the bottom of the recess and having multiple claws being resilient and formed at intervals and protruding from the bottom of the recess; and a shaft hole being formed between the claws; and at least one connector being mounted respectively around the at least one sleeve of the handle, and each one of the at least one connector adjustably pressing the claws of the clamp of a corresponding one of the at least one sleeve and having an inner annular surface having a thread engaging the outer mounting thread of the corresponding sleeve;

an outer edge;

a shoulder being formed on the outer edge; and a mounting tube being formed on and protruding from the shoulder of the outer edge of the connector and abutting the claws of the corresponding clamp, wherein tightening the connector on the sleeve causes the mounting tube to compress the claws and adjustably contract the clamp.

2. The file handle as claimed in claim 1, wherein the handle has two ends;

two sleeves are implemented and respectively formed on the ends of the handle; and two connectors are implemented and respectively formed around the sleeves.

3. The file handle as claimed in claim 2, wherein the clamps of the two sleeves are different sizes.

4. The file handle as claimed in claim 2, wherein the file handle further comprises a cap being detachably mounted through one of the connectors and in a corresponding one of the sleeves of the handle and having an outer surface being a convex;

an inner surface abutting the corresponding connector; and a shaft being formed on and protruding from the inner surface of the cap, corresponding to and detachably mounted in the shaft hole of the clamp.

5. The file handle as claimed in claim 3, wherein the file handle further comprises a cap being detachably mounted through one of the connectors and in a corresponding one of the sleeves of the handle and having an outer surface being a convex;

an inner surface abutting the corresponding connector; and a shaft being formed on and protruding from the inner surface of the cap, corresponding to and detachably mounted in the shaft hole of the clamp.

6. The file handle as claimed in claim 1, wherein the shaft hole in each one of the at least one sleeve is hexagonal.

7. The file handle as claimed in claim 2, wherein each shaft hole is hexagonal.

8. The file handle as claimed in claim 3, wherein the each shaft hole is hexagonal.

9. The file handle as claimed in claim 4, wherein each shaft hole is hexagonal; and the shaft of the cap has a hexagon cross section as the shaft hole of the corresponding clamp.

10. The file handle as claimed in claim 5, wherein each shaft hole is hexagonal; and the shaft of the cap has a hexagon cross section as the shaft hole of the corresponding clamp.

* * * * *